US006039109A

United States Patent [19]

Chagnot et al.

[11] Patent Number: 6,039,109

[45] Date of Patent: Mar. 21, 2000

[54] AIR TO AIR HEAT AND MOISTURE RECOVERY VENTILATOR

[75] Inventors: Catherine J. Chagnot; Joseph Arden Crum, both of Athens, Ohio

[73] Assignee: Stirling Technology, Inc., Athens, Ohio

[21] Appl. No.: 08/743,306

[22] Filed: Nov. 5, 1996

[51] Int. Cl.[7] ..... F23L 15/02

[52] U.S. Cl. ..... 165/8; 165/10; 165/54

[58] Field of Search ..... 165/54, 10, 8

[56] References Cited

U.S. PATENT DOCUMENTS

| | | |
|---|---|---|
| 1,654,294 | 12/1927 | Ljungstrom . |
| 2,807,258 | 9/1957 | Pennington . |
| 3,733,791 | 5/1973 | Dravnieks . |
| 3,844,737 | 10/1974 | Macriss et al. . |
| 4,093,435 | 6/1978 | Marron et al. . |
| 4,188,993 | 2/1980 | Heyn et al. . |
| 4,196,771 | 4/1980 | Nitteberg . |
| 4,426,853 | 1/1984 | Mitani et al. . |
| 4,429,735 | 2/1984 | Nomaguchi et al. . |
| 4,432,409 | 2/1984 | Steele . |
| 4,491,171 | 1/1985 | Zenkner . |
| 4,497,361 | 2/1985 | Hajicek . |
| 4,513,807 | 4/1985 | Rose et al. . |
| 4,542,782 | 9/1985 | Berner . |
| 4,563,126 | 1/1986 | Kobayashi . |
| 4,572,282 | 2/1986 | Ikemura et al. . |
| 4,594,860 | 6/1986 | Coellner et al. . |
| 4,596,284 | 6/1986 | Honmann . |
| 4,611,653 | 9/1986 | Ikemura et al. . |
| 4,688,626 | 8/1987 | Tengesdal . |
| 4,711,293 | 12/1987 | Niwa et al. . |
| 4,727,931 | 3/1988 | Berner . |
| 4,825,936 | 5/1989 | Hoagland et al. . |
| 4,874,042 | 10/1989 | Becker . |
| 4,875,520 | 10/1989 | Steele et al. . |
| 5,069,272 | 12/1991 | Chagnot . |
| 5,183,098 | 2/1993 | Chagnot . |
| 5,285,842 | 2/1994 | Chagnot . |
| 5,595,238 | 1/1997 | Mark et al. ..... 165/9 |

FOREIGN PATENT DOCUMENTS

| | | |
|---|---|---|
| 0030863 | 6/1981 | European Pat. Off. . |
| 0 507 107 A2 | 10/1992 | European Pat. Off. . |
| 2318007 | 10/1974 | Germany . |
| 2839112 | 3/1979 | Germany . |
| 3125504 | 2/1983 | Germany . |
| 58-138992 | 8/1983 | Japan . |
| 55587 | 3/1986 | Japan . |
| 748311 | 4/1956 | United Kingdom . |
| WO 95/35144 | 12/1995 | WIPO . |

*Primary Examiner*—Christopher Atkinson

*Attorney, Agent, or Firm*—Killworth, Gottman, Hagan & Schaeff LLP

[57] ABSTRACT

A ventilator includes a ventilator housing defining an exhaust air flow section and a fresh air flow section, a rotary wheel, a heat and moisture exchange media supported by the rotary wheel and intersecting the exhaust air flow section and the fresh air flow section, a rotary wheel mounting assembly including a first set of guide rollers in contact with a first rim edge portion of the rotary wheel and a second set of guide rollers in contact with a second rim edge portion of the rotary wheel, and a drive roller in contact with one of the rim edge portions. A hub and bearing assembly is provided such that the rotary wheel may tilt with respect to the mounting assembly. A rotary wheel access plate defines an exhaust air outlet and a fresh air inlet and is equipped with an access plate opening assembly. A moisture transfer wick extends across a partition assembly between the exhaust air flow section and the fresh air flow section. A rotary wheel seal positioned between the circumferential rim of the rotary wheel and the ventilator housing includes first and second sealing members pivotally mounted on one end thereof and spring mounted on another end thereof. The rotary wheel, which is designed to enable maintenance of wheel circularity, is mounted so as to be readily removable from the ventilator housing. Similarly, in one embodiment of the present invention, the exchange media is arranged so as to be readily removable from the rotary wheel.

33 Claims, 8 Drawing Sheets

AIR TO AIR HEAT AND MOISTURE RECOVERY VENTILATOR

BACKGROUND OF THE INVENTION

The present invention relates to air to air heat and moisture recovery ventilators and their use to obtain thermally efficient ventilation of buildings and dwellings. Specifically, the present invention relates to an improved rotary wheel heat exchanger mounting arrangement which enables convenient removal of the rotary wheel and/or the exchange media supported by the rotary wheel.

Heat exchangers are used in ventilation systems installed in residential, commercial, and industrial buildings to extract and remove heat and/or moisture from one air stream and transfer the heat and/or moisture to a second air stream. In particular, rotary wheel heat exchangers are known wherein a wheel rotates in a housing through countervailing streams of exhaust and fresh air. In the winter, the heat exchanger extracts heat and moisture from the exhaust stream and transfers the heat and moisture to the fresh air stream while, in the summer, the heat exchanger extracts heat and moisture from the fresh air stream and transfers it to the exhaust stream, preserving building heating/air conditioning while providing desired ventilation.

Conventional commercial, industrial, and residential ventilation systems, such as those illustrated in U.S. Pat. Nos. 5,069,272, 5,183,098, and 5,285,842, utilize rotary heat exchanger wheels having diameters ranging from 25 cm to greater than 100 cm. As heat exchanger wheel size increases, conventional wheel bearings and wheel drive mechanisms are subject to mechanical and operational failure. Accordingly, there is a need for a rotary wheel heat exchanger ventilation system employing an improved heat exchange wheel mounting assembly.

As heat exchanger wheel size increases it is also more difficult and costly to preserve wheel circularity. As wheel circularity degrades, conventional wheel drive mechanisms are less likely to operate properly and ventilation system sealing members are more likely to fail. For example, where a wheel drive roller contacts the outer periphery of a rim body, as is the case with the wheel drive mechanism disclosed in U.S. Pat. No. 5,069,272, it is difficult to maintain roller-to-rim contact if the rim is out of round. Similarly, where a sealing member is provided in contact with the outer periphery of the rim body, it is also difficult to maintain seal-to-rim contact if the rim is out of round. Accordingly, there is a need for a rotary wheel heat exchanger ventilation system employing an improved wheel drive mechanism and mounting assembly. Further, there is a need for a rotary wheel heat exchanger ventilation system wherein wheel drive integrity and ventilation system efficiency are preserved where wheel circularity degrades.

Conventional commercial, industrial, and residential ventilation systems utilizing rotary heat exchanger wheels operate most efficiently if the heat exchange media is cleaned or replaced regularly. The mechanical arrangements of some of the conventional systems make removal and/or cleaning of the heat exchange media difficult and time consuming. Accordingly, there is also a need for a ventilation system which provides for convenient and efficient heat exchange media removal for replacement or cleaning.

Although some of the conventional ventilation systems discussed above transfer moisture as well as heat from an exhaust stream to a fresh air stream, e.g., see U.S. Pat. Nos. 5,069,272 and 5,285,842, these conventional systems rely upon the heat exchange media alone to effect transfer of the moisture. Accordingly, there is a need for a ventilation system which includes a supplemental moisture transfer mechanism.

SUMMARY OF THE INVENTION

This need is met by the present invention wherein a ventilator is provided which incorporates an improved rotary wheel mounting assembly reducing the stress borne by the hub of the rotary wheel, is less susceptible to drive failure where the rotary wheel is out of round, enables convenient and efficient removal and replacement of the heat exchange media, and which incorporates a supplemental moisture transfer mechanism.

In accordance with one embodiment of the present invention, a ventilator is provided comprising: a ventilator housing defining an exhaust air flow section and a fresh air flow section, the exhaust air flow section having an exhaust air inlet and an exhaust air outlet, and the fresh air flow section having a fresh air inlet and a fresh air outlet; a rotary wheel including a substantially circular rim having a first rim edge portion defining a first side of the rotary wheel, a second rim edge portion defining a second side of the rotary wheel, and a circumferential rim body extending between the first and second rim edge portions; an exchange media supported by the rotary wheel, the exchange media intersecting the exhaust air flow section and the fresh air flow section; a rotary wheel mounting assembly coupled to the ventilator housing and comprising a first set of guide rollers in contact with the first rim edge portion and a second set of guide rollers in contact with the second rim edge portion; and a rotary wheel driving assembly comprising a drive roller in contact with one of the first and second rim edge portions. The rotary wheel driving assembly may be coupled to the rotary wheel mounting assembly or to the ventilator housing. An exhaust air circulation fan and a fresh air circulation fan are preferably provided in communication with the exhaust and fresh air flow sections.

The ventilator may further comprise a partition assembly positioned so as to isolate the exhaust air flow section from the fresh air flow section, wherein the partition assembly comprises a first partition positioned adjacent the first side of the rotary wheel, a second partition positioned adjacent the second side of the rotary wheel, a first partition seal extending from the first partition to the exchange media, and a second partition seal extending from the second partition to the exchange media. Specifically, the rotary wheel mounting assembly preferably comprises the partition assembly positioned so as to isolate the exhaust air flow section from the fresh air flow section, wherein the partition assembly comprises a first partition positioned adjacent the first side of the rotary wheel, and a second partition positioned adjacent the second side of the rotary wheel.

The first and second rim edge portions may extend in the direction of a central rotational axis of the rotary wheel so as to enclose a portion of the exchange media. The rotary wheel is positioned substantially within a rotary wheel plane and each guide roller within at least one of the first and second sets of guide rollers preferably includes a positional adjustment assembly operative to move each guide roller towards and away from the rotary wheel plane. The positional adjustment assembly may comprise a pivot bolt and an adjustment bolt.

The ventilator may further comprise a rotary wheel access plate defining the exhaust air outlet and the fresh air inlet, where the access plate is positioned adjacent the first side of the rotary wheel, and where an access plate opening assembly is coupled to the access plate.

A rotary wheel seal may be positioned between the circumferential rim body and the ventilator housing and may include at least one sealing member having first and second sealing member ends. The first sealing member end may be pivotally mounted at a pivot mount to the ventilator housing and the second sealing member end may be spring mounted at a spring mount to the ventilator housing.

The exchange media, which may be secured to a set of spokes extending from a hub of the rotary wheel to the substantially circular rim, preferably defines an un-partitioned continuous surface bounded by the substantially circular rim. The spokes may comprise rigid wires connected to the circumferential rim body and lying substantially in a common plane. The exchange media may be secured to the rotary wheel by thread, wire, clips, hook and loop fasteners, etc. Preferably, the length of the spoke extending between the hub and the substantially circular rim is adjustable.

The exchange media may comprise at least two layers of exchange media secured to opposite sides of a set of spokes extending from a hub of the rotary wheel to the substantially circular rim. Further, the exchange media may be operative to filter particulate matter present in a stream of air passing through the exchange media, where the particulate matter has a cross sectional size of at least about 5 microns. The exchange media may comprise a plurality of distinct layers of material wherein at least one of the layers is preferably a treated layer operative to perform a function selected from the group consisting of moisture removal, particulate removal, odor removal, fire retardation, anti-microbial activity, and other functions related to indoor air quality. Specifically, the exchange media may be treated with silica, activated alumina, a zeolite, and/or carbon.

The rotary wheel mounting assembly is preferably removably secured to the ventilator housing by positioning the mounting assembly in a pair of assembly mounting grooves provided in the ventilator housing.

In accordance with another embodiment of the present invention, a ventilator is provided comprising: a rotary wheel including a substantially circular rim having a first rim edge portion defining a first side of the rotary wheel, a second rim edge portion defining a second side of the rotary wheel, and a circumferential rim body extending between the first and second rim edge portions; an exchange media supported by the rotary wheel; a rotary wheel mounting assembly; a circulation fan mounting plate positioned adjacent the second side of the rotary wheel and defining an exhaust air inlet and a fresh air outlet; an exhaust air circulation fan and a fresh air circulation fan mounted to the circulation fan mounting plate; a ventilator housing supporting the rotary wheel mounting assembly and the circulation fan mounting plate; a rotary wheel access plate defining an exhaust air outlet and a fresh air inlet, the access plate positioned adjacent the first side of the rotary wheel; and an access plate opening assembly coupled to the access plate.

The access plate opening assembly may comprise a hinge and the rotary wheel access plate may be pivotally mounted along a first edge of the ventilator housing via the hinge. Further, the access plate may be coupled to an access plate lifting assembly comprising a pair of pneumatic lifts coupled to opposite sides of the access plate.

A partition assembly is preferably positioned so as to isolate an exhaust air flow section of the ventilator housing from a fresh air flow section of the ventilator housing and a moisture transfer wick positioned adjacent the second side of the rotary wheel and extending across the partition assembly between the exhaust air flow section and the fresh air flow section.

In accordance with yet another embodiment of the present invention, a ventilator is provided comprising: a ventilator housing defining an exhaust air flow section and a fresh air flow section, the exhaust air flow section having an exhaust air inlet and an exhaust air outlet, and the fresh air flow section having a fresh air inlet and a fresh air outlet; a rotary wheel including a substantially circular rim having a first rim edge portion defining a first side of the rotary wheel, a second rim edge portion defining a second side of the rotary wheel, and a circumferential rim body extending between the first and second rim edge portions; an exchange media supported by the rotary wheel, the exchange media intersecting the exhaust air flow section and the fresh air flow section; a rotary wheel mounting assembly coupled to the ventilator housing; a rotary wheel driving assembly; and a rotary wheel seal positioned between the circumferential rim body and the ventilator housing and comprising a first sealing member having a first sealing member end and a second sealing member end, wherein the first sealing member end of the first sealing member is pivotally mounted to the ventilator housing at a first pivot mount and the second sealing member end of the first sealing member is spring mounted to the ventilator housing at a first spring mount.

Similarly, a second sealing member is preferably provided having a first sealing member end and a second sealing member end, wherein the first sealing member end of the second sealing member is pivotally mounted to the ventilator housing at a second pivot mount and the second sealing member end of the second sealing member is spring mounted to the ventilator housing at a second spring mount, wherein the first sealing member end of the second sealing member overlaps the second sealing member end of the first sealing member, and wherein the second sealing member end of the second sealing member overlaps the first sealing member end of the first sealing member.

The ventilator housing may comprise a first seal block assembly including the first pivot mount and the second spring mount and a second seal block assembly including the second pivot mount and the first spring mount. The first seal block assembly and the second seal block assembly are positioned adjacent the substantially circular rim and spaced approximately 180° apart relative to the periphery of the rim. The first sealing member may be positioned such that when the rotary wheel rotates in a first direction the first sealing member is urged against the substantially circular rim. The first pivot mount may comprise a first sealing member pin resting in a first pin catch formed in a seal block assembly. The first sealing member pin may pass through a first pin slot formed in a sealing member.

In accordance with yet another embodiment of the present invention, an exchange media wheel is provided comprising: a rim having a first rim edge portion defining a first side of the rotary wheel, a second rim edge portion defining a second side of the rotary wheel, and a rim body extending between the first and second rim edge portions; a hub; a set of ribs including at least one pair of adjacent ribs wherein each rib extends from the hub to the rim; and an exchange media comprising a plurality of divided media portions positioned between adjacent ribs, wherein each of the divided media portions are secured to at least one of the adjacent ribs.

Each of the divided media portions are preferably secured to the pair of adjacent ribs and may be removable from the exchange media wheel. Each of the pair of adjacent ribs may include rigid channels adapted to receive peripheral portions of the divided media portions. Further, the rim may include rigid channels adapted to receive a peripheral portion of the divided media portions. Each of the divided media portions may comprise a plurality of distinct layers of exchange media material.

According to yet another embodiment of the present invention, a rotary exchange media assembly is provided comprising: a rotary wheel including (i) a rim having a first rim edge portion defining a first side of the rotary wheel, a second rim edge portion defining a second side of the rotary wheel, and a rim body extending between the first and second rim edge portions, (ii) a hub, and (iii) at least one support member extending from the hub to the rim; a rotary wheel engaging mechanism; an exchange media secured to the rotary wheel assembly; and a bearing assembly coupled to the hub and defining a bearing assembly axis, the bearing assembly being designed to permit the rotary wheel to tilt relative to the bearing assembly axis and, preferably, relative to the rotary wheel engaging mechanism. The bearing assembly may comprise a single ball bearing arrangement or a single roller bearing arrangement.

Accordingly, it is an object of the present invention to provide an ventilator which incorporates an improved rotary wheel mounting assembly, is less susceptible to drive failure where the rotary wheel is out of round, enables convenient and efficient removal and replacement of the heat exchange media, and which incorporates a supplemental moisture transfer mechanism.

DETAILED DESCRIPTION OF THE INVENTION

Figure 1:
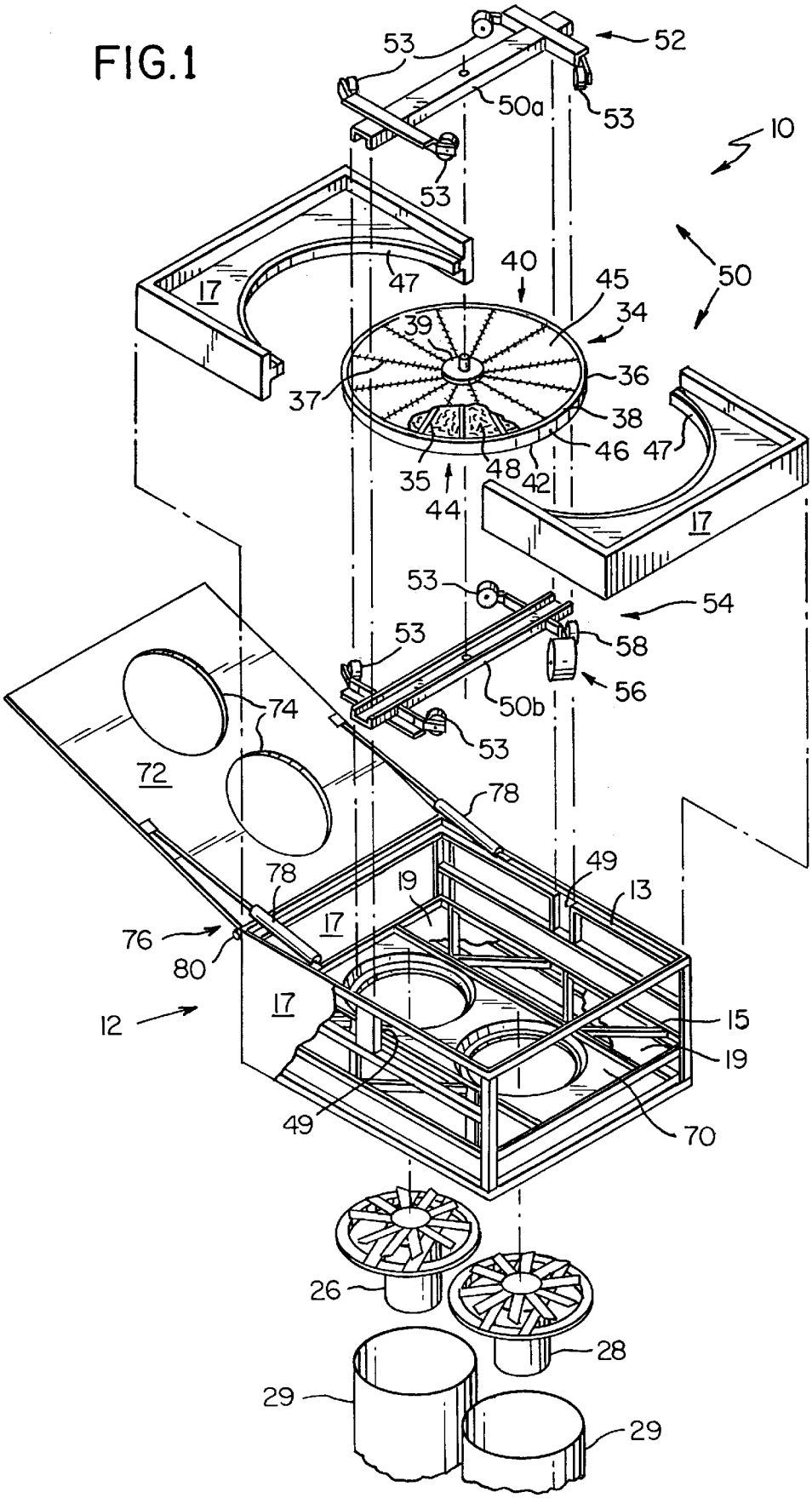
FIG. 1 is an exploded perspective view of a ventilator according to the present invention.
Figure 4B:
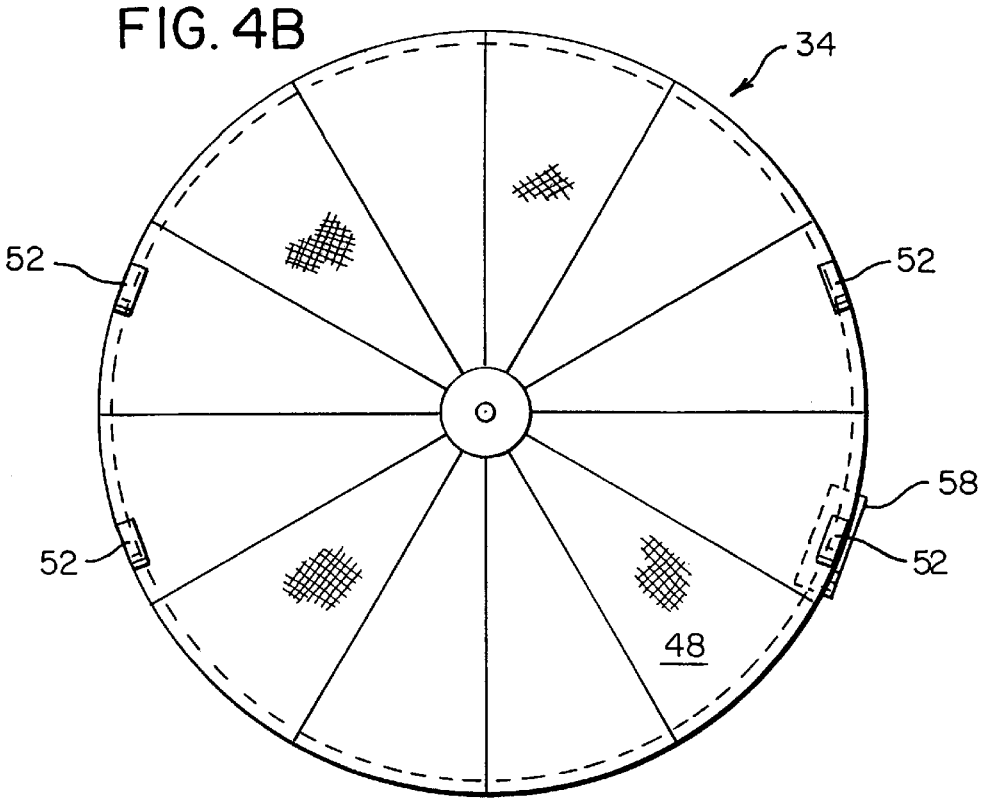
FIGS. 4A and 4B are side and top plan views, respectively, illustrating the rotary wheel, a guide roller, and the drive roller in the ventilator of the present invention.
Figure 2:
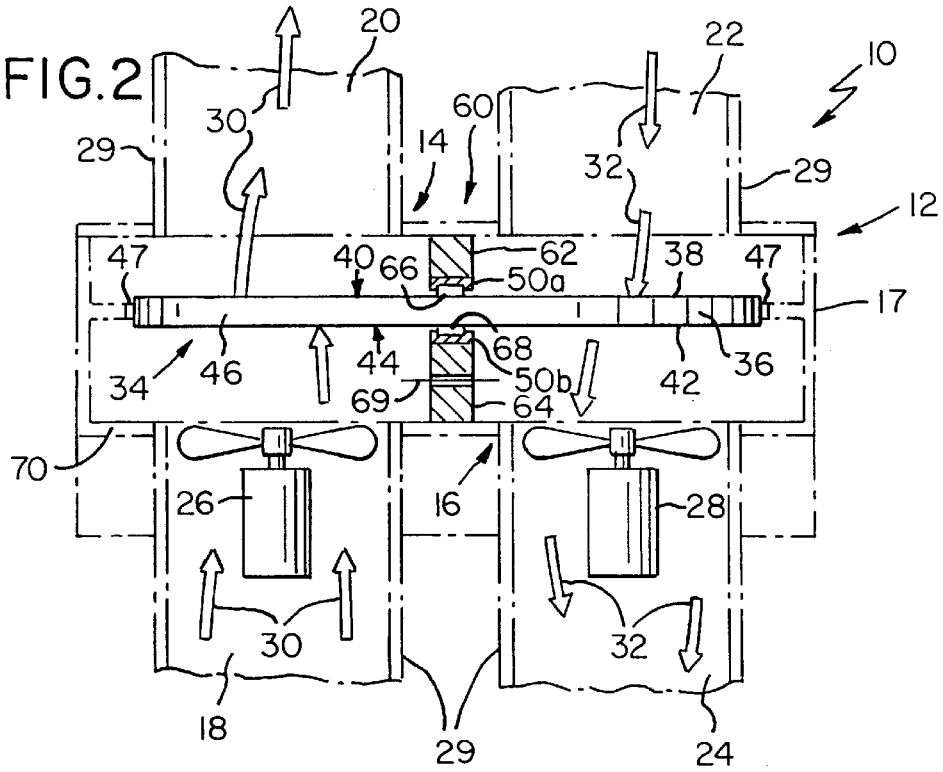
FIG. 2 is a side elevational view, partially is cross section, of a ventilator according to the present invention.

Referring to FIGS. 1 and 2, a ventilator 10 is shown comprising a ventilator housing 12 defining an exhaust air flow section 14 and a fresh air flow section 16 and comprising a frame assembly 13, an inner frame assembly 15, an inner frame assembly shell 19 shown partially broken away in FIG. 1, and a housing body 17 enclosing the frame assembly 13 and the inner frame assembly 15. The housing body 17, shown partially broken away in FIG. 1, comprises a rigid shell lined with a thermally insulating material, e.g., a foam or fiber lined sheet metal shell. It is contemplated by the present invention, however, that a rigid thermally insulating material alone may be utilized in place of the lined sheet metal shell throughout all or part of the ventilator housing 12 depending upon the strength of the rigid insulating material. It is further contemplated that a variety of materials and structural framing arrangements may be utilized to form the supportive housing of the present invention.

The exhaust air flow section 14 includes and extends between an exhaust air inlet 18 and an exhaust air outlet 20, while the fresh air flow section 16 includes and extends between a fresh air inlet 22 and a fresh air outlet 24. A motor driven exhaust air circulation fan 26 is positioned in communication with the exhaust air flow section 14 and a motor driven fresh air circulation fan 28 is positioned in communication with the fresh air flow section 16. The motor driven exhaust fan 26 is connected to a conventional power source (not shown) via conventional electrical connections (not shown) and is oriented so as to enable production of an exhaust air flow stream (indicated by arrows 30) through the exhaust air flow section 14. The motor driven fresh air fan 28 is connected to a conventional power source (not shown) via conventional electrical connections (not shown) and is oriented so as to enable production of a fresh air flow stream (indicated by arrows 32) through the fresh air flow section 16.

A rotary wheel 34 includes a substantially circular rim 36, a hub and bearing assembly 39, a first rim edge portion 38 defining a first side 40 of the rotary wheel 34, a second rim edge portion 42 defining a second side 44 of the rotary wheel 34, and a circumferential rim body 46 extending between the first and second rim edge portions 38, 42. Although the hub and bearing assembly 39 may comprise any one of a variety of commercially available designs, a specific embodiment of the hub and bearing assembly 39 is described below with reference to FIGS. 8 and 9.

A rotary wheel seal 47, a particular embodiment of which is described in detail below with respect to FIGS. 5A–7B, is positioned between the circumferential rim body 46 and the housing body 17 to prevent the passage of air between the housing body 17 and the rotary wheel 34.

A heat and moisture exchange media 48 intersecting the exhaust air flow section 14 and the fresh air flow section 16 is supported by the rotary wheel 34. The first and second rim edge portions 38, 42 extend in the direction of a central rotational axis of the rotary wheel 34 so as to enclose a portion of the exchange media 48, see FIG. 4C. However, as is illustrated in FIG. 4D, the first and second rim edge portions 38, 42 may extend away from a central rotational axis of the rotary wheel 34 or, as a further alternative, may terminate at the circumference of the rim 36, i.e., not extend in either direction.

The heat and moisture exchange media 48 is a random matrix media consisting of a plurality of interrelated small diameter, heat-retentive, fibrous material. Such materials may be randomly interrelated by mechanical, thermal, or chemical means for interrelating. Mechanical means for interrelating may be, for example, needle-punching. Thermal means for interrelating may, for example, comprise radiant heat or ultrasonic methods for bonding adjacent fibers or filaments. Chemical means for interrelating may, for example, involve known methods for bonding adjacent, randomly interrelated filaments with adhesives.

Whether entirely random, or superficially maintaining some semblance of a pattern comprising a randomly interrelated assemblage of materials having somewhat more ordered patterns, the fibrous material of the exchange media 48, preferably, forms a mat of material which is easy to work with, handle, and cut to shape. The exchange media 48 may be made from one or more of many commercially available filaments, fibers, staples, wires, or yarn materials, natural (such as metal wire) or man-made (such as polyester and nylon). Filament diameters from substantially about 25 microns to substantially about 150 microns may be used. Below substantially about 25 microns, the small size of the filaments creates excessive resistance to air flow, and above about 150 microns, inefficient heat transfer results due to decreased surface area of the larger filaments. Single strand filaments from substantially about 25 microns to substantially about 80 microns in diameter are preferred, for example a 60 denier polyester needle-punched felt having filament diameters of about 75 to 80 microns.

The mat of material which forms the random matrix media should have a porosity (i.e., percentage of open space in total volume) of between substantially about 83% and substantially about 96%. Below substantially about 83%, resistance to air flow becomes too great, and above substantially about 96% heat transfer becomes ineffective due to the free flow of air. Preferably the mat thickness should be less than 61" to prevent excessive resistance to air flow. Porosity is preferable from substantially about 90% to substantially about 94%, as for example, with 60 denier polyester needle-punched felt, having a porosity of about 92.5%. Representative of random matrix materials which may be used in exchange media 48, 60 denier polyester needle-punch felt has a specific gravity of approximately 1.38, thermal conductivity of approximately 0.16 watts/m °K and specific heat of approximately 1340 j/Kg °K.

The exchange media 48 functions as a filter for particles as small as 5 microns. For example, pollen in the fresh air flow stream (indicated by arrows 32) driven to the surface of the exchange media 48 does not substantially penetrate the exchange media 48 and may be removed by the exhaust air flow stream (indicated by arrows 30). Pre-filters (not shown) may be positioned in the exhaust air inlet 18, the fresh air inlet 22, the fresh air outlet 24, or elsewhere to supplement the filtering achieved by the exchange media 48 or to prevent the exchange media 48 from becoming clogged with particles.

Figure 4A:
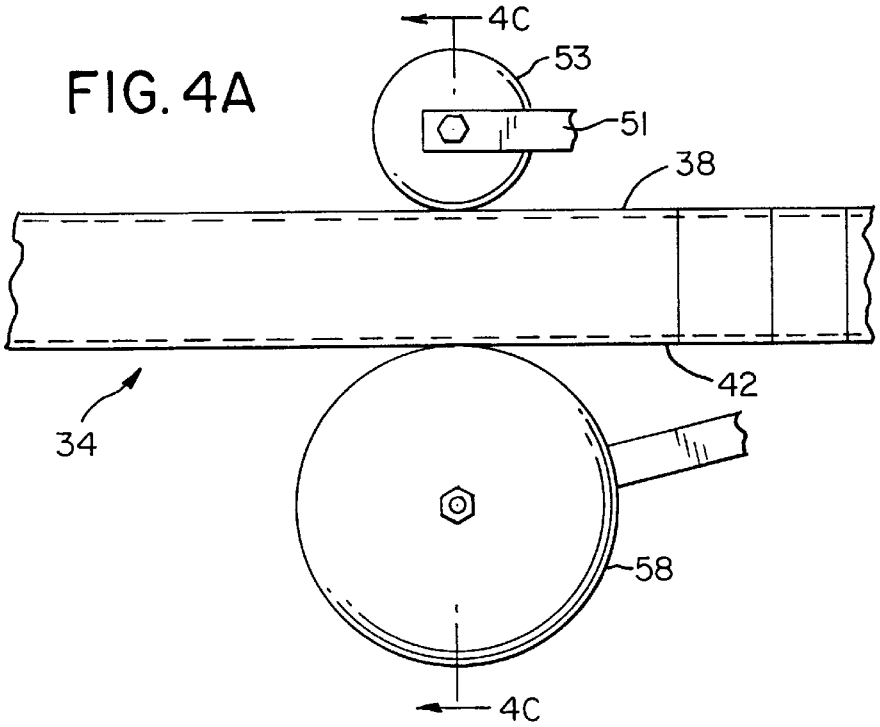
Figure 4C:
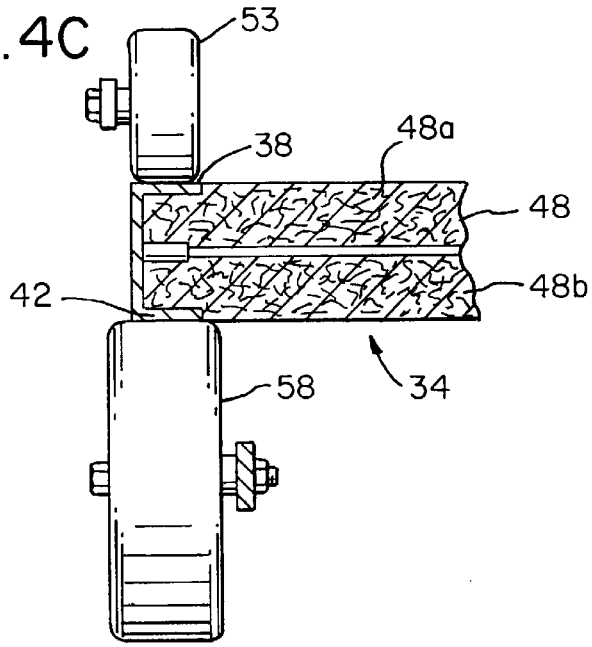
FIG. 4C is a partial cross sectional view of the rotary wheel, guide roller, and drive roller taken along line 4C—4C of FIG. 4A.
Figure 4D:
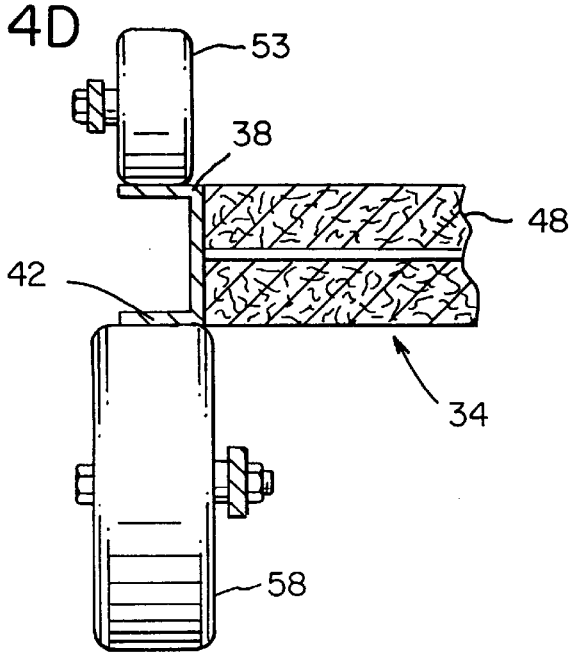
FIG. 4D is a partial cross sectional view of an alternative rotary wheel arrangement to that illustrated in FIG. 4C.

Although according to the embodiments of the present invention disclosed herein the exchange media 48 comprises a pair of exchange media layers 48*a*, 48*b*, see FIG. 4C, secured about the spokes 35 of the rotary wheel 34 by passing thread 37 through the exchange media 48 and around individual spokes 35 at multiple points, the exchange media 48 may be supported by the rotary wheel 34 in any conventional manner, e.g, wire, clips, hook and loop fasteners, etc. The spokes 35 provide a means by which the circularity of the rotary wheel 34 can be conveniently maintained through adjustment of individual spoke length, i.e. the length of the spoke extending between the hub and the rim is adjustable. The spokes 35, which comprise rigid metal wires connected between the circumferential rim body 46 and to the hub and bearing assembly 39 and lying substantially in a common plane, also provide a means by which an exchange media 48 having an un-partitioned continuous surface bounded by the circular rim 36 may be secured to the rotary wheel 34. In this manner, the fresh air flow stream (indicated by arrows 32) and the exhaust air flow stream (indicated by arrows 30) are forced to pass through the exchange media 48, as opposed to spaces between partitions of the exchange media 48. Preferably, the common plane defined by the spokes 35 bisects the rim body 46 around the entire circumference of the rotary wheel 34.

Figure 5A:
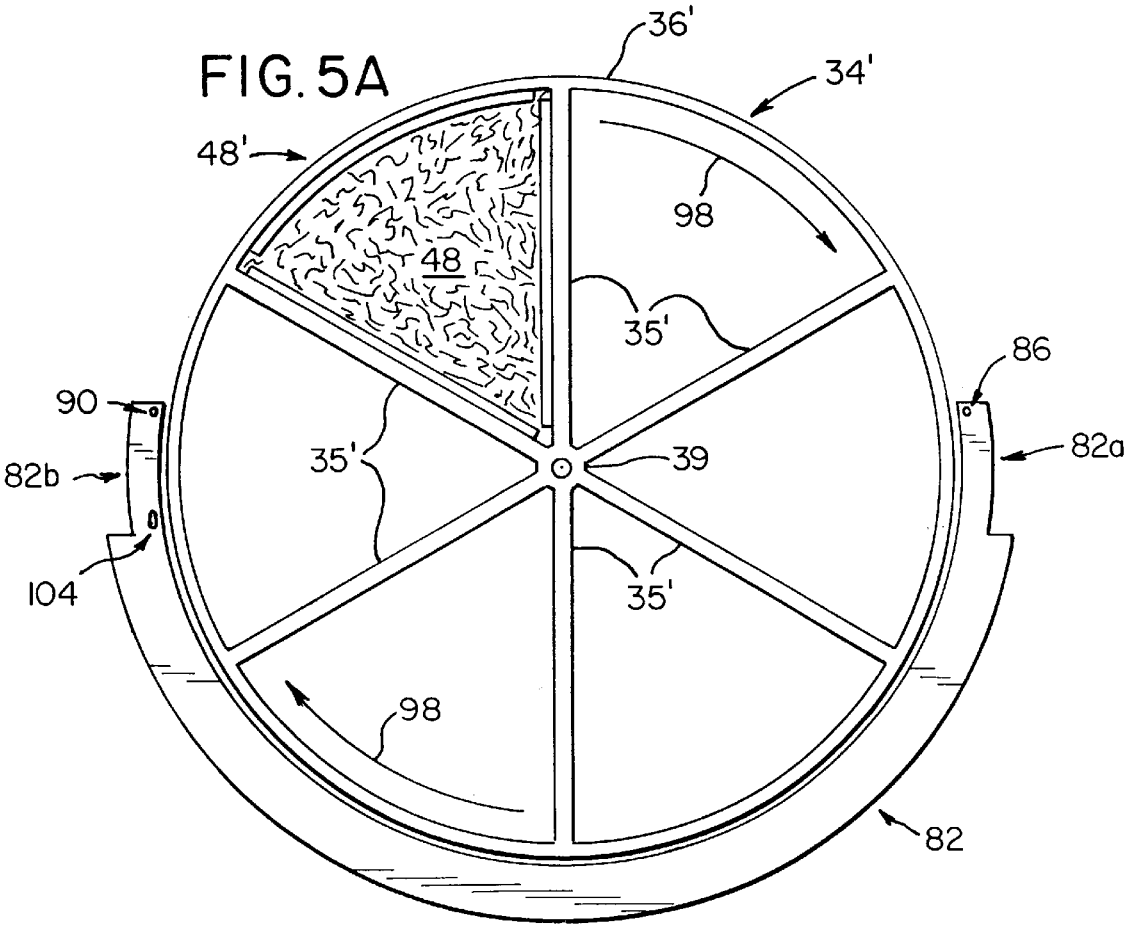
FIGS. 5A and 5B illustrate another embodiment of the rotary wheel and the positioning of the first and second rotary wheel sealing members relative to the rotary wheel in the ventilator of the present invention.
Figure 5B:
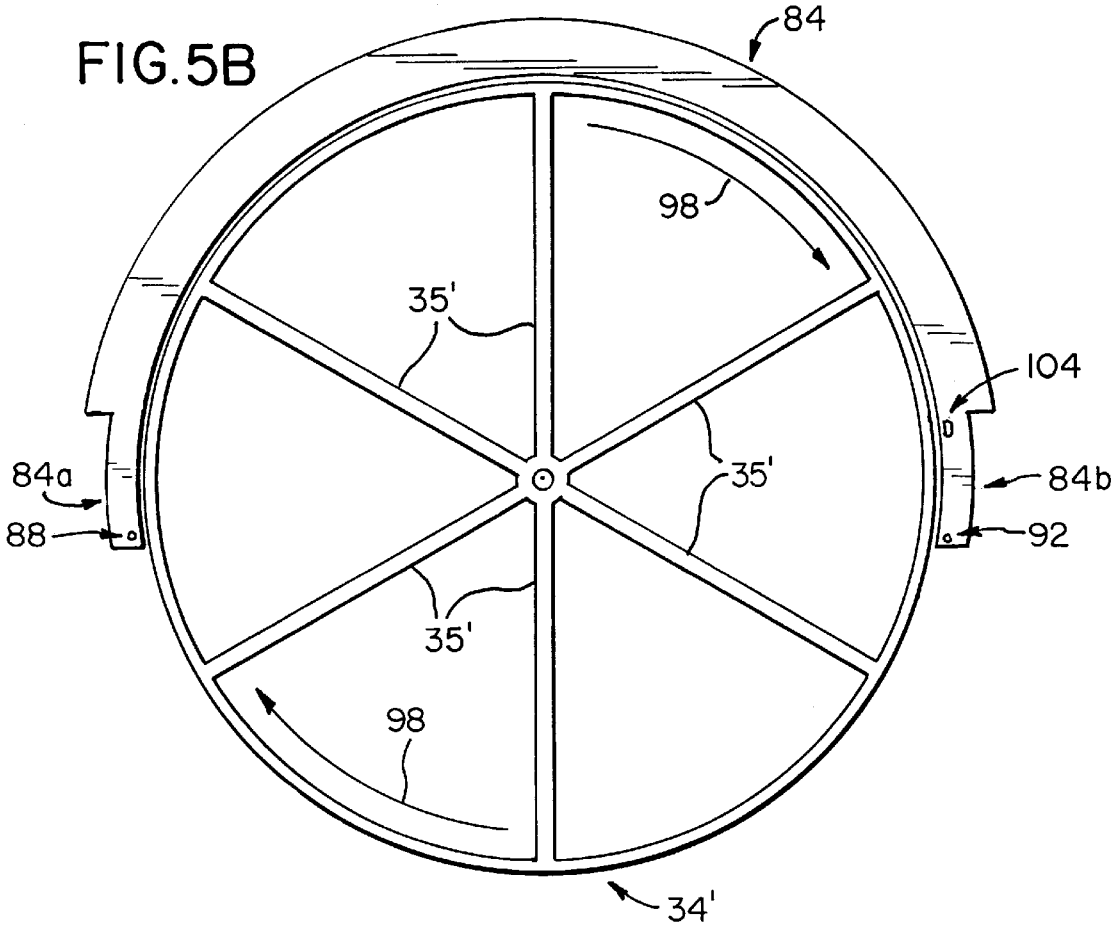
Figure 5C:
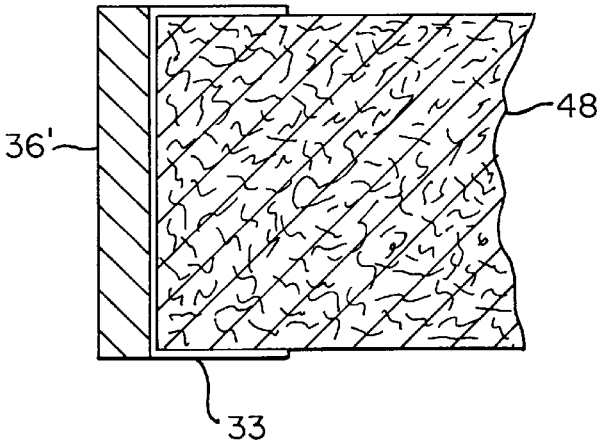
FIG. 5C is a cross sectional view of a portion of the rotary wheel in FIG. 5A.

Referring now to FIGS. 5A and 5C, according to another embodiment of the present invention, a rotary wheel 34' comprises integrally formed plastic ribs 35' and a substantially circular rim 36'. The integral construction is typically achieved through an injection molding process but may also be formed in another suitable manner. Heat and moisture exchange media 48, a portion of which is illustrated in FIG. 5A, is secured the ribs 35' extending from the hub 39 of the rotary wheel to the substantially circular rim. For illustrative purposes, only a portion of the exchange media 48 is shown in FIG. 5A although it should be understood that, according to the present invention, substantially the entire circle defined by the rotary wheel 34' is occupied by the exchange media 48.

The exchange media 48 comprises divided media portions 48' positioned between adjacent ribs 35'. FIG. 5A illustrates the positioning of one of the divided media portions 48'. Rigid channels 33 are secured, via conventional securing means, e.g., an adhesive, to the ribs 35' and the rim 36' so as to receive and secure peripheral portions of the divided media portions 48'. The rigid channels are preferably constructed of a rigid plastic material but may also be constructed of other materials suitable for supporting the weight of the exchange media 48 and the force of fresh and exhaust air flow streams 30, 32 moving through the exchange media 48. In this manner, it is not necessary to provide screens enclosing and supporting the exchange media. Further, removal of the exchange media for cleaning or replacement is enabled because each divided media portion 48' may be separately removed from the rotary wheel 34'. It is contemplated by the present invention that structure other than rigid channels 33 may be provided to secure the exchange media between the ribs 35', e.g., tape, hook and loop fasteners, etc.

The exchange media 48 may comprise a single unitary mass of material or a plurality of distinct layers of material. Where a plurality of distinct layers of exchange media are utilized, individual layers may be specifically treated to encourage moisture removal, particulate removal, odor removal, fire retardation, anti-microbial activity, and other improvements related to indoor air quality. For example, an individual layer of the exchange media may be treated with silica, activated alumina, and/or a zeolite to improve moisture transfer or activated carbon to remove odors and particulate matter. Further, the exchange media may be enclosed on one or both sides by a screen 45.

A rotary wheel mounting assembly 50, which is illustrated with reference to FIGS. 3 and 4A–4C in addition to FIG. 1, is coupled to the ventilator housing 12 and comprises an upper mounting assembly frame 50*a*, a lower mounting assembly frame 50*b*, a first set of guide rollers 52 in contact with the first rim edge portion 38, and a second set of guide rollers 54 in contact with the second rim edge portion 42. Similarly, a rotary wheel driving assembly 56 is coupled to the rotary wheel mounting assembly 50 and comprises a motor driven drive roller 58 in contact with the second rim edge portion 42. It is contemplated by the present invention that the drive roller 58 may alternatively be arranged so as to contact the first rim edge portion 38 and that the rotary wheel driving assembly 56 may be coupled to the ventilator housing 12 as opposed to the rotary wheel mounting assembly 50. The drive roller and guide rollers are preferably formed of 50–110 durometer hardness plastic.

Figure 3:
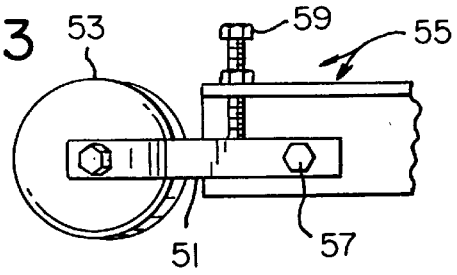
FIG. 3 is an illustration, partially broken away, of a portion of a rotary wheel mounting assembly in the ventilator of the present invention.

Referring to FIG. 3 in addition to FIGS. 1 and 2, each guide roller 53 within the first and second sets of guide rollers 52, 54 is coupled to a positional adjustment assembly 55 which is operative to move the guide roller 53 towards and away from the rotary wheel 34 or a rotary wheel plane in which the rotary wheel 34 is to be positioned. The positional adjustment assembly 55 comprises a pivot bolt 57 and an adjustment bolt 59. To position the guide roller 53, the pivot bolt 57 is loosened to permit a guide roller arm 51 to pivot about the pivot bolt 57 when the adjustment bolt 59 is rotated clockwise and counterclockwise. In this manner, each guide roller 53 may be positioned to forcibly engage one of the rim edge portions 38, 42 such that the rotary wheel 34 is secured between the first and second set of guide rollers 52, 54. It is contemplated by the present invention that any number of guide rollers 53 may be utilized within each set of guide rollers 52, 54 depending upon the size and weight of the rotary wheel 34 and exchange media 48 supported therein. Further, it is contemplated by the present invention that other mechanical arrangements by be employed to adjustably secure the rim edge portions 38, 42 between the first and second set of guide rollers, e.g., a spring loaded mechanical assembly.

A partition assembly 60, not shown in FIG. 1 but illustrated in FIG. 2, is positioned so as to isolate the exhaust air flow section 14 from the fresh air flow section 16. The partition assembly 60 comprises a first partition 62, including the upper mounting assembly frame 50*a*, positioned adjacent the first side 40 of the rotary wheel 34, a second partition 64, including the lower mounting assembly frame 50*b*, positioned adjacent the second side 44 of the rotary wheel 34, a first partition seal 66 extending from the first partition 62 to the exchange media 48, and a second partition seal 68 extending from the second partition 64 to the exchange media 48. As will be appreciated by one skilled in the art, a variety of materials, including a TEFLON®-based tape, as disclosed in U.S. Pat. No. 5,069,272, may be utilized to form the first and second partition seals 66, 68.

Referring now back to FIG. 1, the circulation fan mounting plate 70, in conjunction with the inner frame assembly 15, the inner frame assembly shell 19, the partition assembly 60, the housing body 17, and a rotary wheel access plate 72, described in detail below, seal-off or enclose respective portions of the exhaust and fresh air flow sections 14, 16 along portions of the exhaust and fresh air flow streams 30, 32 extending between the exhaust and fresh air circulation fans 26, 28 and access plate ports 74. This air-tight sealing arrangement ensures maximum operating efficiency by containing the exhaust air flow stream 30 within the exhaust air flow section 14 and the fresh air flow stream 32 within the fresh air flow section 16. Further, the rotary wheel seal 47, in cooperation with the housing body 17, ensures that a large portion of the respective exhaust and fresh air flow streams pass through the exchange media 48.

The circulation fan mounting plate 70 is supported by the ventilator housing 12, and the exhaust air circulation fan 26 and the fresh air circulation fan 28 are mounted to the circulation fan mounting plate 70. The exhaust and fresh air circulation fans 26, 28 are oppositely oriented so as to create the oppositely directed exhaust and fresh air flow streams 30, 32. Alternatively, the exhaust and fresh air circulation fans 26, 28 may be similarly oriented but oppositely rotated so as to create the oppositely directed exhaust and fresh air flow streams 30, 32. It is contemplated by the present invention that the exhaust and fresh air circulation fans 26, 28 may be positioned on opposite sides of the rotary wheel 34.

A moisture transfer wick 69 is positioned adjacent the second side 44 of the rotary wheel 34 and extends across the partition assembly 60 between the exhaust air flow section 14 and the fresh air flow section 16 to transfer moisture from one section to the other. A moisture transfer wick, as utilized in the present specification, comprises a material or device that conveys liquid by capillary action or other means. For example the wick 69 may comprise a length of natural or synthetic, braided or non-braided, cloth, thread, or other material. It is contemplated by the present invention that a mechanism may be provided to induce a pressure differential across the partition assembly 60 between the exhaust air flow section 14 and the fresh air flow section 16 to encourage transfer of moisture along the wick 69.

The rotary wheel access plate 72 includes access plate ports 74 which define the exhaust air outlet 20 and the fresh air inlet 22. Access plate 72 is positioned adjacent the first side of rotary wheel 40. An access plate opening assembly 76 is coupled to access plate 72 such that access plate 72 is easily opened and closed. In this manner, convenient maintenance of exchange media 48 and/or other components within the ventilator housing 12 is enabled. Specifically, the opening assembly comprises a pair of pneumatic lifts 78 and a hinge assembly 80 coupling access plate 72 to ventilator housing 12 such that access to the interior of the ventilator housing 12 is achieved by swinging open access plate 72 with the aid of pneumatic lifts 78. It is contemplated by the present invention that a variety of arrangements could be substituted for the pneumatic lifts 78 and hinge assembly 80 to facilitate opening of access plate 72.

A pair of assembly frame mounting grooves 49 are provided such that, upon opening of the access plate 72, the upper mounting assembly frame 50*a* and the rotary wheel 34 may be conveniently removed from the ventilator housing 12 and subsequently reinstalled. In this manner, the exchange media 48 may be cleaned, modified or replaced to optimize the operational characteristics of the ventilator 10. Typically, a frame assembly and rotary wheel securing means (not shown), e.g., a bolt on the hub and bearing assembly 39, must be removed prior to the removal of the upper mounting assembly frame 50*a* and the rotary wheel 34.

It is contemplated by the present invention that the ventilator housing 12 may be provided as a single unit or cartridge not including the motor driven fans 26 and 28 and the associated air ducts 29. In this manner, the single unit or cartridge may be positioned within an existing air duct system to intercept respective forced exhaust and fresh air supplies. It is further contemplated by the present invention that the size of the rotary wheel 34, the ventilator housing 12, and the associated hardware can vary according to the particular intended operating environment, e.g, residential, industrial, etc. Specifically, the diameter of the exchange media can vary from about 25 cm to greater than 100 cm.

Referring again to FIGS. 5A–7B, a particular embodiment of the rotary wheel seal 47 includes a first sealing member 82 having a first sealing member end 82*a* and a second sealing member end 82*b*. The first sealing member end 82*a* of the first sealing member 82 is pivotally mounted to the ventilator housing 12 at a first pivot mount 86 and the second sealing member end 82*b* of the first sealing member 82 is spring mounted to the ventilator housing 12 at a first spring mount 90. Similarly, the rotary wheel seal includes a second sealing member 84 having a first sealing member end 84*a* and a second sealing member end 84*b*. The first sealing member end 84*a* of the second sealing member 84 is pivotally mounted to the ventilator housing 12 at a second pivot mount 88, and the second sealing member end 84*b* of the second sealing member 84 is spring mounted to the ventilator housing 12 at a second spring mount 92. As will be appreciated by one skilled in the art, a variety of materials, including a TEFLON®-based material, as disclosed in U.S. Pat. No. 5,069,272, may be utilized to form the first and second sealing members 82, 84.

Figure 6A:
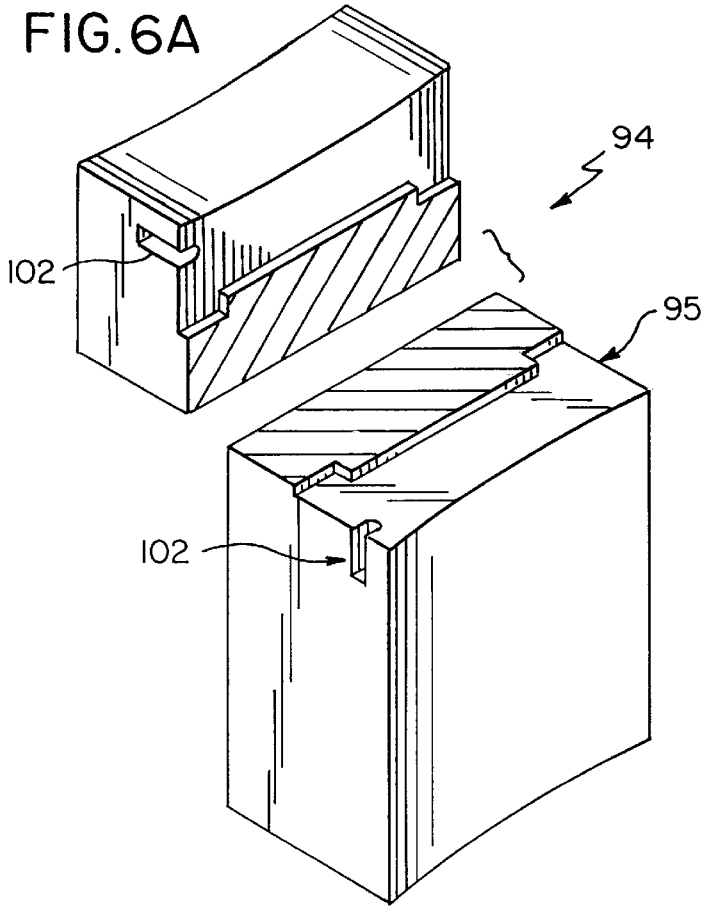
FIGS. 6A and 6B are perspective views, broken and unbroken respectively, of a sealing block in the ventilator of the present invention.
Figure 6B:
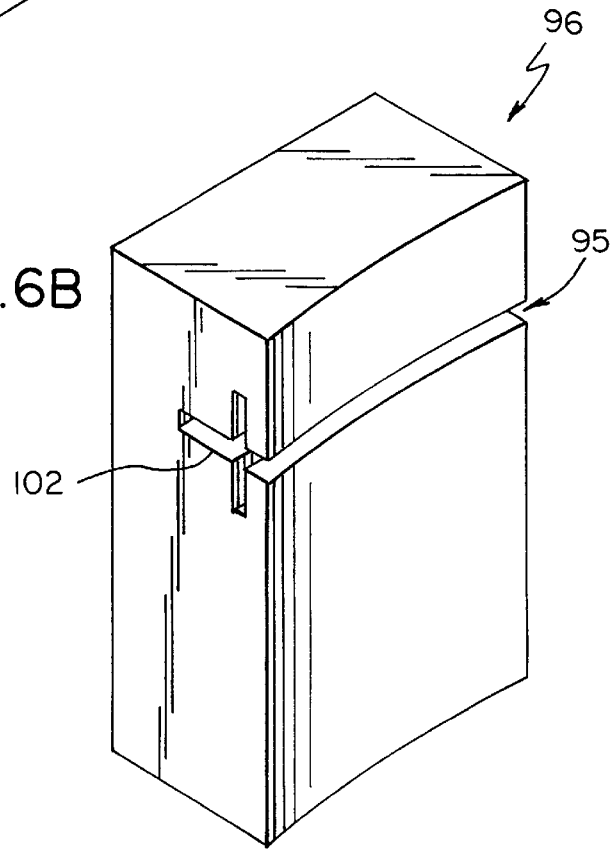
Figure 7A:
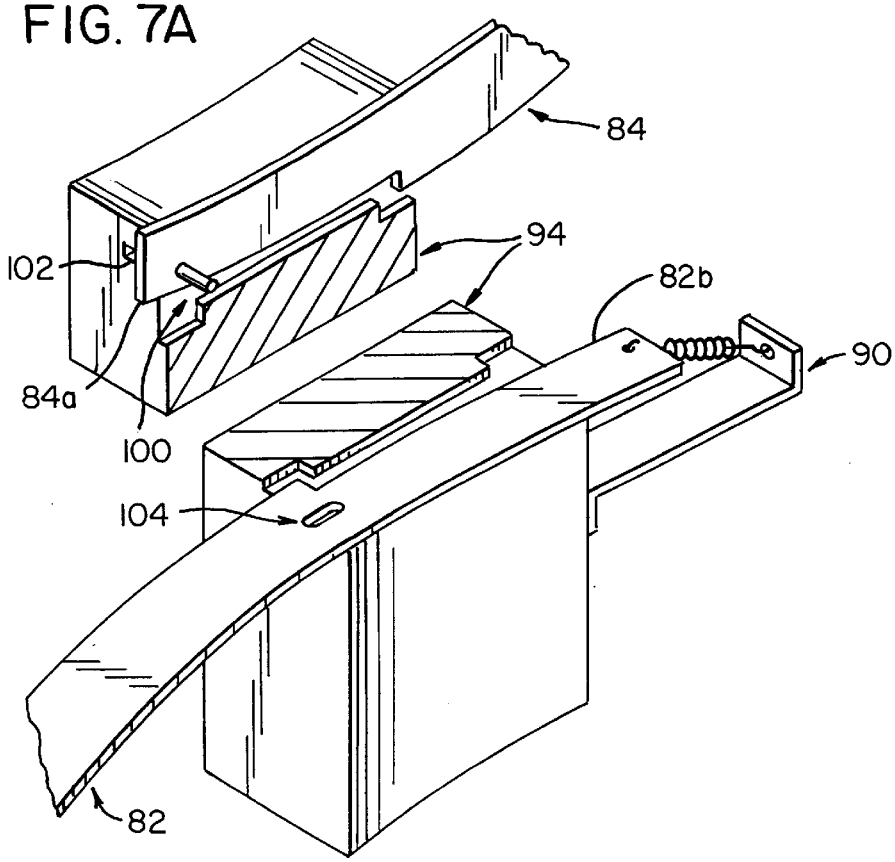
FIGS. 7A and 7B are perspective views, broken and unbroken respectively, illustrating the positioning of the sealing block and first and second sealing members in the ventilator of the present invention.
Figure 7B:
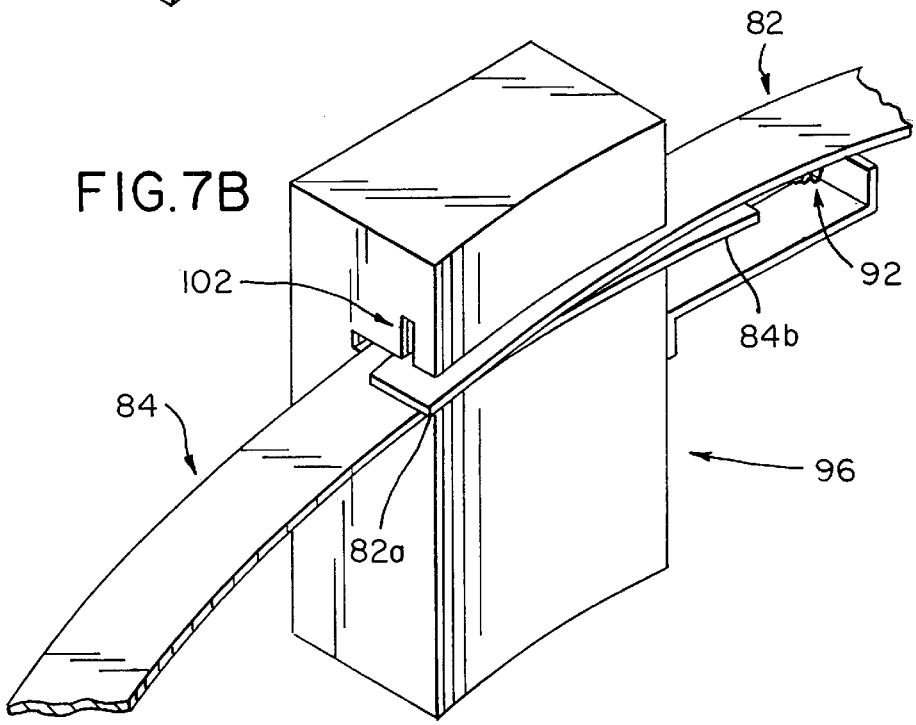

The first sealing member end 84*a* of the second sealing member 84 overlaps the second sealing member end 82*b* of the first sealing member 82 and the second sealing member end 84*b* of the second sealing member 84 overlaps the first sealing member end 82*a* of the first sealing member 82, see FIGS. 7A and 7B. A first seal block assembly 94, which is illustrated in FIGS. 6A and 7A broken away along a cutting plane for illustrative purposes only, defines a sealing member passageway 95 and includes first pivot mount 86 provided therein and second spring mount 92 attached thereto. A second seal block assembly 96 defines a sealing member passageway 95 and includes second pivot mount 88 provided therein and first spring mount 90 attached thereto. The first seal block assembly 94 and the second seal block assembly 96 are positioned adjacent substantially circular rim 36' and are spaced approximately 180° apart relative to the periphery of rim 36'. The first and second pivot mounts 86, 88 each comprise a sealing member pin 100 resting in a pin catch 102 formed in first and second seal block assemblies 94, 96. Each sealing member pin 100 passes through a corresponding pin slot 104 formed in one of the first and second sealing members 82, 84. When rotary wheel 34' rotates in a first direction 98, any contact between substantially circular rim 36' and the first sealing member 82 will cause the first sealing member 82 to pivot about the first pivot mount 86 and abut or urge against the periphery of substantially circular rim 36'. Similarly, any contact between substantially circular rim 36' and second sealing member 84 will cause second sealing member 84 to pivot about second pivot mount 88 and abut or urge against the periphery of substantially circular rim 36'. In this manner, a strong seal is maintained between housing body 17 and rotary wheel 34' while rotary wheel 34' rotates. Further, noting that the frictional moving contact between the first and second sealing members 82, 84 and the circular rim 36' causes the sealing members 82, 84 to gradually wear, the strong seal is maintained as the sealing members 82, 84 wear because the sealing members 82, 84 continually abut or urge against the periphery of substantially circular rim 36'.

Figure 8:
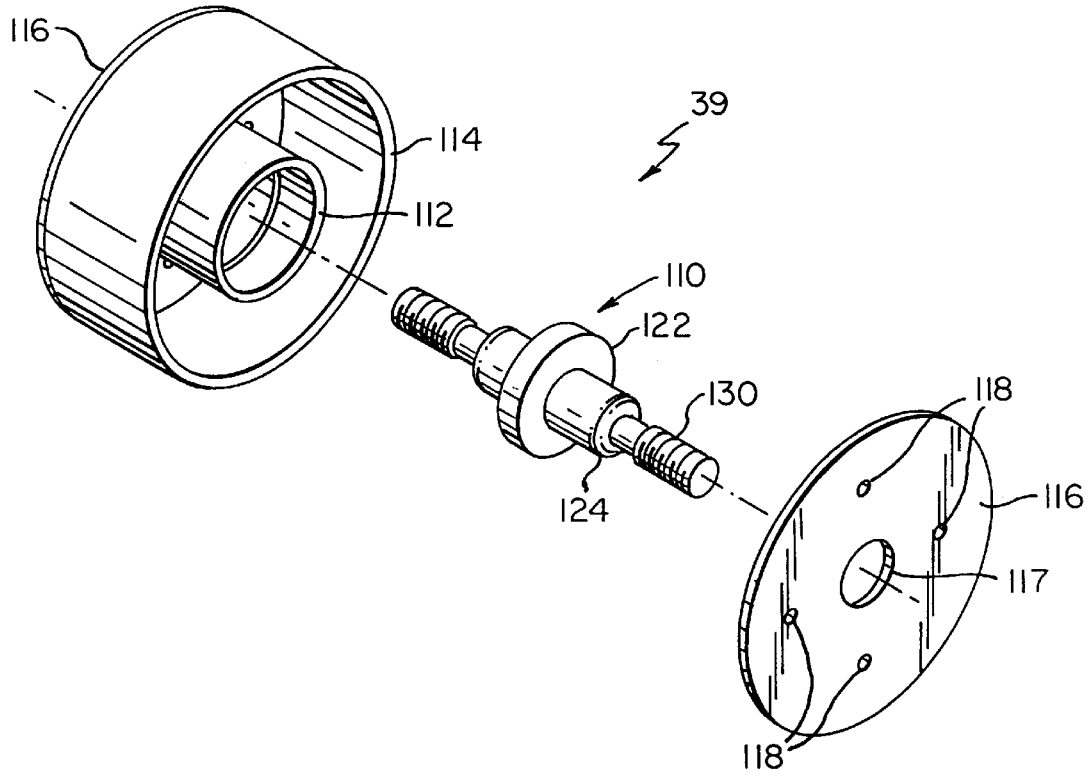
FIG. 8 is an exploded perspective view of a bearing and hub assembly according to the present invention.
Figure 9:
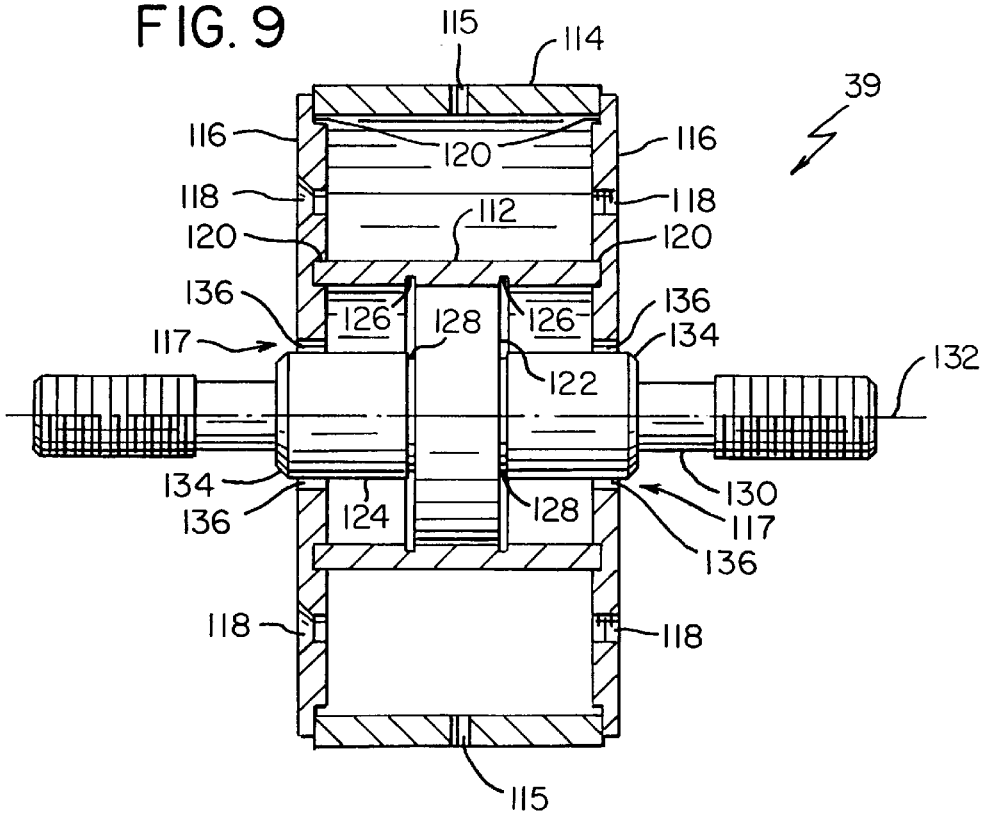
FIG. 9 is a side view, partially in cross-section, of the bearing and hub assembly of FIG. 8.

Referring now to FIGS. 8 and 9, a bearing assembly 110, an inner hub portion 112, and an outer hub portion 114 are fixed between opposing hub plates 116. The outer hub portion 114 includes spoke mounting holes 115. It is contemplated by the present invention that, where a particular rotary exchange wheel to be fitted with the hub and bearing assembly 39 illustrated in FIGS. 8 and 9 includes ribs or other radial support members, as opposed to spokes, appropriate mounting hardware, holes, or slots may be provided in the outer hub portion 114.

Four hub plate screws or bolts (not shown) are provided in hub plate mounting holes 118 such that the inner and outer hub portions 112, 114 are secured within respective annular hub mounting grooves 120 formed in the opposing hub plates 116. The bearing assembly 110 comprises an outer bearing race 122 fixed to the inner hub portion 112 at outer bearing race mounts 126. An inner bearing race 124 is fixed to an axle 130 at inner bearing race mounts 128. The outer bearing race mounts 126 and the inner bearing race mounts 128 comprise snap rings or another conventional mounting arrangement. The axle 130 comprises axle shoulders 134 which engage a portion of a wheel mounting assembly between the axle shoulders 134 and a securing bolt (not shown) threaded onto the axle 130.

The bearing assembly 110 defines a bearing assembly axis 132 and the bearing assembly 110 permits a rotary wheel mounted to the hub and bearing assembly 39 to tilt relative to the bearing assembly axis 132 and relative to a rotary wheel mounting assembly (not shown). In this manner, slight misalignments or irregularities in the particular mounting assembly in use will not inhibit free rotation of the rotary wheel about the axle 130. To facilitate the axial tilting, the bearing assembly 110 comprises a single bearing and opposing apertures 117 formed in the opposing hub plates 116 are sized so as to provide a minimum tilting clearance 136 between the inner race 124 and the opposing hub plates 116. The single bearing may be a conventional ball bearing arrangement or sphere roller bearing available from McGill Precision Bearings, Valparaiso, Ind.

Having described the invention in detail and by reference to preferred embodiments thereof, it will be apparent that modifications and variations are possible without departing from the scope of the invention defined in the appended claims.

What is claimed is:

1. A ventilator comprising:

a ventilator housing defining an exhaust air flow section and a fresh air flow section, said exhaust air flow section having an exhaust air inlet and an exhaust air outlet, and said fresh air flow section having a fresh air inlet and a fresh air outlet;

a rotary wheel defining a central rotational axis extending from a first side of said rotary wheel to a second side of said rotary wheel, said rotary wheel including a substantially circular rim having a first rim edge portion defining said first side of said rotary wheel, a second rim edge portion defining said second side of said rotary wheel, and a circumferential rim body extending between said first and second rim edge portions;

an exchange media supported by said rotary wheel, said exchange media intersecting said exhaust air flow section and said fresh air flow section;

a rotary wheel mounting assembly coupled to said ventilator housing and comprising a first set of guide rollers in contact with said first rim edge portion and a second set of guide rollers in contact with said second rim edge portion; and a rotary wheel driving assembly comprising a drive roller in contact with one of said first and second rim edge portions.

2. A ventilator as claimed in claim 1 further comprising:

an exhaust air circulation fan in communication with said exhaust air flow section; and a fresh air circulation fan in communication with said fresh air flow section.

3. A ventilator as claimed in claim 1 further comprising a partition assembly positioned so as to isolate said exhaust air flow section from said fresh air flow section, wherein said partition assembly comprises a first partition positioned adjacent said first side of said rotary wheel, a second partition positioned adjacent said second side of said rotary wheel, a first partition seal extending from said first partition to said exchange media, and a second partition seal extending from said second partition to said exchange media.

4. A ventilator as claimed in claim 1 wherein said rotary wheel mounting assembly comprises a partition assembly positioned so as to isolate said exhaust air flow section from said fresh air flow section, wherein said partition assembly comprises a first partition positioned adjacent said first side of said rotary wheel, and a second partition positioned adjacent said second side of said rotary wheel.

5. A ventilator as claimed in claim 1 wherein said first and second rim edge portions extend in the direction of said central rotational axis along said first and second sides of said rotary wheel so as to enclose a portion of said exchange media.

6. A ventilator as claimed in claim 1 wherein said rotary wheel is positioned substantially within a rotary wheel plane and wherein each guide roller within at least one of said first and second sets of guide rollers in contact with said first and second rim edge portions includes a positional adjustment assembly operative to move each guide roller towards and away from said rotary wheel plane in a direction parallel to said central rotational axis.

7. A ventilator as claimed in claim 6 wherein said positional adjustment assembly comprises a pivot bolt and an adjustment bolt.

8. A ventilator as claimed in claim 1 further comprising a rotary wheel access plate defining said exhaust air outlet and said fresh air inlet, said access plate positioned adjacent said first side of said rotary wheel, and an access plate opening assembly coupled to said access plate.

9. A ventilator as claimed in claim 1 further comprising a rotary wheel seal positioned between said circumferential rim body and said ventilator housing and including at least one sealing member having first and second sealing member ends wherein said first sealing member end is pivotally mounted at a pivot mount to said ventilator housing and said second sealing member end is spring mounted at a spring mount to said ventilator housing.

10. A ventilator as claimed in claim 1 wherein said exchange media defines an un-partitioned continuous surface extending across said first and second sides of said rotary wheel, wherein said exchange media is bounded by the substantially circular rim.

11. A ventilator as claimed in claim 1 wherein said exchange media is secured to a set of spokes extending from a hub of said rotary wheel to said substantially circular rim.

12. A ventilator as claimed in claim 1 wherein said rotary wheel includes spokes extending from a hub of said rotary wheel to said substantially circular rim and wherein said spokes comprise rigid wires connected to said circumferential rim body and lying substantially in a common plane.

13. A ventilator as claimed in claim 12 wherein a length of said spoke extending between said hub and said substantially circular rim is adjustable.

14. A ventilator as claimed in claim 1 wherein said exchange media is secured to a set of ribs extending from a hub of said rotary wheel to said substantially circular rim.

15. A ventilator as claimed in claim 14 wherein said exchange media comprises divided media portions positioned between adjacent ribs and wherein said ventilator further comprises rigid channels adapted to receive peripheral portions of said divided media portions.

16. A ventilator as claimed in claim 15 wherein said rigid channels are secured to at least one of said ribs and said rim body.

17. A ventilator as claimed in claim 1 wherein said rotary wheel includes ribs extending from a hub of said rotary wheel to said substantially circular rim and wherein said ribs and said substantially circular rim are integrally formed.

18. A ventilator as claimed in claim 1 wherein said exchange media is secured to said rotary wheel by securing hardware selected from the group consisting of thread, wire, clips, and hook and loop fasteners.

19. A ventilator as claimed in claim 1 wherein said exchange media comprises at least two layers of exchange media secured to opposite sides of a set of spokes extending between said two layers of exchange media from a hub of said rotary wheel to said substantially circular rim.

20. A ventilator as claimed in claim 1 wherein said exchange media is operative to filter particulate matter present In a stream of air passing through said exchange media.

21. A ventilator as claimed in claim 20 wherein said particulate matter has a cross sectional size of at least about 5 microns.

22. A ventilator as claimed in claim 1 wherein said exchange media comprises a plurality of distinct layers of material.

23. A ventilator as claimed in claim 1 wherein said exchange media comprises at least one treated layer operative to perform a function selected from the group consisting of moisture removal, particulate removal, odor removal, fire retardation, anti-microbial activity, and other functions related to indoor air quality.

24. A ventilator as claimed in claim 1 wherein said exchange media comprises a treated layer including a material selected from the group consisting of silica, activated alumina, a zeolite, and carbon.

25. A ventilator as claimed in claim 1 wherein said rotary wheel mounting assembly is removably secured to said ventilator housing.

26. A ventilator as claimed in claim 1 wherein said rotary wheel mounting assembly is positioned in a pair of assembly mounting grooves provided in said ventilator housing, and wherein the assembly mounting grooves are arranged to permit removal and subsequent reinstallation of said rotary wheel from and to said ventilator housing.

27. A ventilator as claimed in claim 1 wherein said rotary wheel driving assembly is coupled to the rotary wheel mounting assembly.

28. A ventilator as claimed in claim 1 wherein said rotary wheel driving assembly is coupled to the ventilator housing.

29. A ventilator as claimed in claim 1 wherein said rotary wheel comprises a bearing assembly coupled to said hub and defining a bearing assembly axis, said bearing assembly being designed to permit said rotary wheel to tilt relative to said bearing assembly axis.

30. A ventilator comprising:

a rotary wheel including a substantially circular rim having a first rim edge portion defining a first side of said rotary wheel, a second rim edge portion defining a second side of said rotary wheel, and a circumferential rim body extending between said first and second rim edge portions;

an exchange media supported by said rotary wheel:

a rotary wheel mounting assembly;

a circulation fan mounting plate positioned adjacent said second side of said rotary wheel and defining an exhaust air inlet and a fresh air outlet;

an exhaust air circulation fan and a fresh air circulation fan mounted to said circulation fan mounting plate;

a ventilator housing supporting said rotary wheel mounting assembly and said circulation fan mounting plate;

a partition assembly is positioned so as to isolate an exhaust air flow section of said ventilator housing from a fresh air flow section of said ventilator housing; and a moisture transfer wick positioned adjacent said second side of said rotary wheel and extending through said partition assembly between said exhaust air flow section and said fresh air flow section.

31. A ventilator as claimed in claim 30 further comprising:

a rotary wheel access plate defining an exhaust air outlet and a fresh air inlet, said access plate positioned adjacent said first side of said rotary wheel; and an access plate opening assembly coupled to said access plate, wherein said access plate opening assembly comprises a hinge and said rotary wheel access plate is pivotally mounted along a first edge of said ventilator housing via said hinge.

32. A ventilator as claimed in claim 31 wherein said access plate is coupled to an access plate lifting assembly.

33. A ventilator as claimed in claim 31 wherein said access plate lifting assembly comprises a pair of pneumatic lifts coupled to opposite sides of said access plate.

* * * * *